United States Patent [19]

Higgins

[11] 4,162,763

[45] Jul. 31, 1979

[54] WATER JET VALVE ASSEMBLY

[75] Inventor: Bobby L. Higgins, Dallas, Tex.

[73] Assignee: Camsco, Inc., Richardson, Tex.

[21] Appl. No.: 868,244

[22] Filed: Jan. 10, 1978

[51] Int. Cl.[2] ..... B05B 1/08

[52] U.S. Cl. ..... 239/101; 175/422

[58] Field of Search ..... 239/101, 102; 299/17; 175/67, 422

[56] References Cited

U.S. PATENT DOCUMENTS

| | | | |
|---|---|---|---|
| 3,490,696 | 1/1970 | Cooley | 239/102 X |
| 3,601,987 | 8/1971 | Nevskogo et al. | 299/17 X |
| 3,997,111 | 12/1976 | Thomas et al. | 299/17 X |
| 4,074,858 | 2/1978 | Burns et al. | 239/101 X |

*Primary Examiner*—Robert W. Saifer

*Attorney, Agent, or Firm*—Richards, Harris & Medlock

[57] ABSTRACT

A high-pressure fluid jet valve assembly is disclosed utilizing a double-acting piston actuated by a spool valve to reversibly actuate the valve stem. The valve stem selectively gates high-pressure cutting fluid through a seat arrangement directly into an output expansion section. Directly coupled to the expansion section is a valve head holding a jewel holder used to shape the high-pressure fluid beam for cutting purposes. The valve seal, stem and seat arrangement are designed to prevent leaching of the stem by the effect of high-pressure water, yet allow the cycling time in the order of 25 milliseconds.

10 Claims, 2 Drawing Figures

WATER JET VALVE ASSEMBLY

BACKGROUND OF THE INVENTION

This invention relates to quick-acting fluid valve assemblies coupled to fluid jet cutting nozzles. Within the prior art, a wide variety of known valve configurations is available for use in regulating fluid flow. However, within the context of fluid cutting jet technology, suitable valve structures have not yet attained a level of reliability to guarantee their success on a commercial scale.

Fluid jet cutting utilizes a fine, shaped beam of fluid emanating through a jewel nozzle at approximately 40,000–60,000 psia. The cutting fluid is typically water which passes through an intensifier to generate the pressures for cutting. Accordingly, any valve which is to be utilized in the context of fluid jet cutting must be able to accommodate high-pressure fluid input without degradation of the valve structure itself. At high pressures, in the range of 40,000–60,000 psia, problems of leaching of the valve stem are quite common. Because most prior art valves utilize conventional steel stems, the impact of high-pressure fluid will tend to erode or leach the steel away, creating leaks in the valve structure. Additionally, the valve seat which is not particularly yieldable will tend to leach or otherwise deform under the impact of high-pressure fluid as it passes from the fluid input to the expansion section, thereby creating an imperfect seal structure between the seat and stem. Accordingly, prior art valve systems have proven unreliable over long cycle lives because of a propensity to develop leaks at the stem and seal point.

Replacement of valves is a costly, time-consuming procedure which reduces throughput of fluid cutting jet systems. Typically, the operating life objective of such a valve has been established in the range of 250,000 cycles. This stringent requirement is necessitated by the fact that the remainder of a fluid jet cutting system is generally maintainable over a comparable duty cycle lifetime, and accordingly, the valve should at least maintain that same level of reliability. Also, such valves should be capable of quick maintenance with a minimum of time and expense.

Moreover, valve assemblies used in fluid jet cutting are required to cycle—i.e., that is, supply then cut-off water within very short cycle times, typically about 3 seconds. Typically, cycling time in the range of 75 milliseconds is required so that it does not effect the throughput of the machine. Such short cycling is required because the fluid jet cutting is under the control of a computer, and as the cutting operation proceeds, throughput of the machine is a function of the ability of a fluid jet valve to cycle in response to cutting commands. Although many fast-acting valve arrangements are known, none is commercially known and available which combines a 25 millisecond cycle time together with the ability to control 60,000 psia fluid. The reliability requirements imposed in fluid jet cutting, together with use considerations—namely, high-pressure water and fast duty or cycle time—have made prior art valve arrangements unsuited for use in fluid jet systems.

Another problem existing in prior art devices, common in quick-reaction valves, is a propensity of leakage of the working fluid, primarily hydraulic fluid or oil, with the regulated fluid, in this case water. After repeated cycling, contamination and breakdown of a valve seal used to isolate the stem from the switch section of the valve tends to occur, thereby resulting in a leakage of hydraulic fluid into the regulated fluid. This problem is acutely present in situations where high-pressure fluid is utilized for purposes of regulation since breakdown of the seal at the stem portion is a function of deformation and leaching as a result of the influence of such high-pressure fluid.

Accordingly, there has existed within the field of fluid jet cutting a necessity for a valve assembly which has a rapid cycling time—in the order of 25 milliseconds—yet maintains the ability to cycle and regulate high-pressure water in the range of 60,000 psia over a duty cycle lifetime of approximately 250,000 cycles. Also, in view of the high pressures involved, extreme safety requirements must be met to isolate the cutting fluid when the hydraulics are off—i.e., the valve must be maintained in a normally closed position.

SUMMARY OF THE INVENTION

Given the deficiencies in the prior art, this invention relates to a valve assembly which is uniquely suited for use in fluid jet cutting systems. The ability to cycle within a duty range of 25 milliseconds is accomplished by means of a double-acting piston accepted in response to a four-way hydraulic valve. The double-acting piston arrangement utilizes hydraulic fluid acting on one side of the piston during a first portion of the duty cycle to drive the piston and stem arrangement down into a locking, or off configuration, and oil in the opposite side of the double-acting piston to force the stem up against the pressure of a return spring to open the valve by driving the double-acting piston upward, thereby allowing the stem to open under the influence of high-pressure fluid. Accordingly, by means of hydraulic switching, quick reaction cycling time is achieved.

Prevention of leaching of the valve stem is accomplished by use of a high-strength corrosion resistant steel. The stem itself has a head element fashioned of a soft steel which effectively seats on the valve seat in a locking arrangement. The seat itself is fashioned from a hard corrosion resistant steel such that any deformation under the influence of high-pressure fluid can be accommodated by a matching deformation of the stem head. Accordingly, problems of leaching as a function of high-pressure utilization and deformation of the stem seat arrangement are alleviated by appropriate choice of materials.

The high-pressure working fluid seal is accomplished by means of a four-segment valve seal having components of different physical properties for selective deformation. The influence of high-pressure fluid causes the seal members to compress, thereby deforming the elements, including the bronze backing to maintain a close mating surface against stem, side wall and packing load. The bronze backing material will be deformed to completely fill the area behind the backing ring and prevent its extrusion past the bronze ring. The backing ring supports the seal which prevents leaking between the wall and the stem. The valve stem and seals are occasionally replaced during service of the unit. To aid in such service and aleviate critical alignment problems, the stem is free-floated in the piston and can be removed from the bottom of the assembly.

The valve structure is operably coupled to an output expansion section having a valve head accommodating a jewel holder for a fluid jet nozzle. The expansion section serves to focus and shape the high-pressure water stream for ultimate beam focusing and dispersion through the nozzle element.

Accordingly, it is an object of this invention to provide a high-pressure fluid jet valve assembly which may operably handle high-pressure water over a protracted duty cycle lifetime.

It is another object of this invention to provide for a valve assembly having the ability to cycle 60,000 psi cutting fluid within 25 milliseconds.

Still another object of this invention is to provide for a fluid jet valve assembly which operably couples a high pressure, quick reaction valve with an output expansion section holding a fluid jet nozzle.

Yet another object of this invention is to provide a high-pressure fluid valve having a valve seal arrangement utilizing a deformable bronze packing separating the high-pressure fluid section from the hydraulic section of the valve.

A further object of this invention is to provide for a high-pressure fluid valve assembly which overcomes the defects of prior art high-pressure valves and provides for safe use in high-pressure operation by means of a normally closed mode of operation using preloaded springs.

These and other objects of this invention will become apparent from the drawings and a description of the preferred embodiment which follows.

DESCRIPTION OF THE PREFERRED EMBODIMENT

Figures 1, 2:
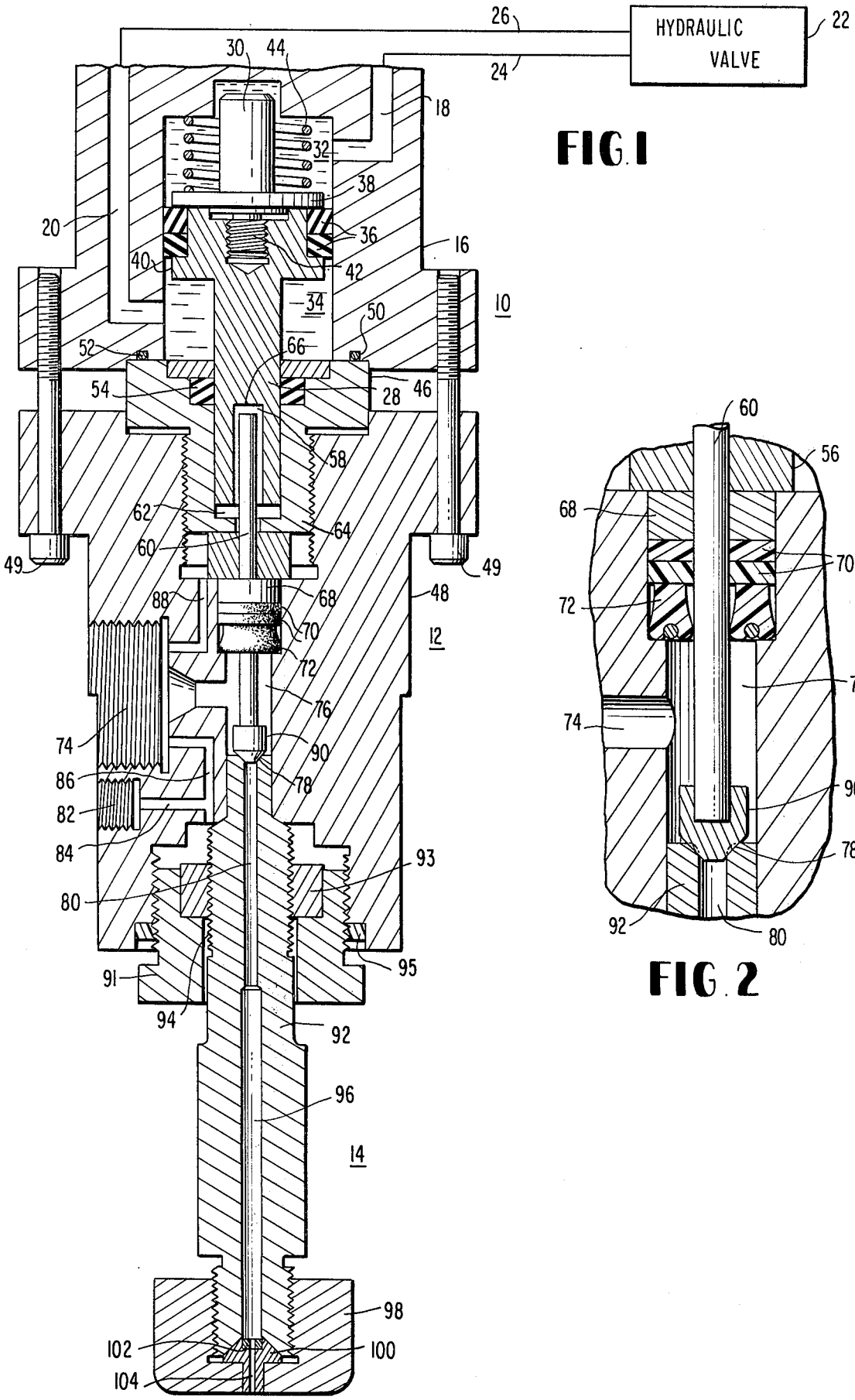
FIG. 1 is a side cut-away view of the water jet valve assembly in accordance with this invention.
FIG. 2 is an exploded partial side view of the valve assembly in accordance with this invention showing the high-pressure valve seat arrangement.

Referring now to FIGS. 1 and 2, the preferred embodiment of this invention is shown. The invention broadly comprises three sections; the first, an actuation section denoted as 10, a valve section 12 and an output section 14. The actuation section is an hydraulic switch section encased in housing 16. The housing 16 has two ducts 18 and 20 in fluid communication with a spool valve 22 by means of hydraulic lines 24 and 26. The valve may be a Skinner solenoid actuated spool type. This valve is modified by replacing the conventional single return spring with a two-stage spring of unequal force characteristics. The low force at the end of the stroke is accommodated by a weak spring, and the greater force available at the closed position of the solenoid is utilized by a second spring of greater strength. This spring combination tracks the non-linear force curve of the solenoid and, therefore, stores more energy than a conventional single return spring. The result is faster, more positive valve turn-off. Disposed within the housing 16 is a double-acting piston 28 having an upper section 30. The double-acting piston sections 28 and 30 are disposed in a chamber having an upper section 32 and a lower section 34 separated by hydraulic seals 36. The hydraulic seals engage the wall of the reservoir to maintain isolation between the upper chamber 32 and the lower chamber 34, and are typically fashioned from a molythane material.

The upper piston element has a flange member 38, and the lower piston element has a similar flange member 40 used to provide respective backings for the hydraulic seals 36. By means of a threaded attachment 42, the upper piston member may be threadably engaged into the lower piston member to effectuate a sealing contact between the flanges 38 and 40 on the seals 36b The double-acting piston section 30 is biased downward into a closed position by means of a valve return spring 44, having one end abutting against the upper portion of the chamber 32 and a lower section disposed in an abutting relationship on the flange 38. The valve return spring tends to bias the entire actuation unit and valve section into a normally closed relationship. The return spring 44 is preloaded so that in the event of a hydraulic failure the double-acting piston 28 will be in a closed position, thereby sealing the valve in an inoperative position.

Separating the actuation section 10 from the valve section 12 is a packing load nut 46. Nut 46 is threadably engaged into the housing 48 of the valve section and has an annular recess 50 holding a static oil seal 52 to provide a sealing engagement between the upper portion of the load nut 46 and the housing 16. When the bolts 49 are tightened, load nut 46 has machined concentric parts which align housings 16 and 48. A molythane hydraulic seal 54 provides sealing pressure in the range of 3,000 psi to keep hydraulic fluid out of the valve section.

The lower portion of the packing load nut bears on a stainless steel packing load 56. The lower portion of the double-acting piston 28 has a recess 58 into which the valve stem 60 protrudes. Between the lower surface of the lower double-acting piston and the upper surface of the packing load nut, in recess 58, there exists a free space 62 to allow downward movement of the piston section 28 without physical contact of the packing load nut lower portion 64.

Hence, when the double-acting piston is driven downward by means of hydraulic fluid in line 18, the upper surface 66 will contact the top of the valve stem 60, forcing the valve stem downward, while not physically contacting the lower surface of the load packing nut 64.

Referring now to FIG. 2, there is shown in greater detail the seal arangement between the packing load nut and the valve section. A first packing load 56, generally a hard steel, provides a backing for the seal structure itself. The seal structure sequentially comprises a bronze backing 68, molythane backing rings 70 and a molythane seal 72 having an O-ring structure 74 therein. The purpose of the packing section is to prevent water from permeating into the hydraulic section of the actuation portion of the system. In response to high-pressure water used as input through port 74 into chamber 76, pressure is placed on the valve seal to the point where the bronze backing 68 abuts on the steel packing load 56. The bronze is selected from a free machining type which will have good dimensional qualities under ambient conditions, but will deform under the influence of high-pressure water. That deformation enhances the sealing characteristics of the valve seal, but is in the plastic range in the sense that deformation is permanent past the elastic region of the bronze. Accordingly, as the valve is actuated, high-pressure water fills the chamber 76 and flows past the valve seat 78 into the expansion chamber 80 for eventual output through a nozzle element. At the same time, pressure is created in the chamber 76, tending to urge the seal members upward into a packing or locked arrangement against the packing load 56. The seal members are progressively less yieldable so that pressures are relieved to prevent failure of individual seal elements. During this cycle of operation, the bronze backing 68 will ultimately deform to remove any clearance behind the backing rings 70 which support seal 72.

In view of the fact that high pressures must be constrained in predictable areas, any leak path must be vented to atmosphere to prevent catastrophic failure. For that purpose, a bleed port 82 is utilized in the housing 48 having various bleed lines 84 and 86 to provide for pressure relief through the bleed port 82. An additional bleed 88 is provided at the input.

The valve stem 60 is fashioned from steel having a high strength and anti-corrosion properties to combat the influence of high-pressure water since there exists a propensity for accelerated oxidation of steel. Similarly, of crucial importance is the maintenance of a good seal at the valve seat between the tip of the valve stem 90 and the annular seat portion on the top end of the valve seat load nut 92 to insure an adequate seal. The tip of the valve stem 90 is fashioned from a soft-grade steel of high malleability, typically Type 303 having the ability to deform under high pressure to effectuate a sealing arrangement at the slightly radiused point 78 even if slight discontinuities in the sealing surface on element 92 exist. This choice of materials also prevents galling with the load nut 92 at contact point 78.

The valve seat load nut 92 is threadably engaged into housing 48 by means of threads 94 as shown in FIG. 1. A cap nut 91 is provided to lock the load nut 92 into housing 48. Nut 91 bears on a thrust bushing 93 as shown, and a nylon seal 95 is provided to prevent leaks onto the cutting area. Hence, any leaks in the lower section would tend to exhaust through bleed 84.

Disposed in the valve seat load nut 92 is a central bore 80 which, at its lower point, expands to an output expansion section 96. The ratio of length-to-diameter of the output expansion section is used for purposes of beam shaping of the water jet flow. Threadably engaging in the lower portion of the output expansion section is a valve head 98 having a jewel holder 100. The jewel holder holds a jewel nozzle 102, typically sapphire. The jewel nozzle 102 is held in position by means of pressure, although mechanical detents in the jewel holder may be used to effectuate a better fit. The output jet eminates through port 104 from the jewel holder of the valve head to produce a finely-shaped, high-pressure water jet in the range of 60,000 psia.

In operation, the spool drive 22 is actuated in response to computer control (not shown) to cycle on and off the valve section 12 in response to a predetermined cut regime. When a cut is to commence, the spool drive is cycled to form hydraulic switching by forcing hydraulic fluid through line 26 into conduit 20. The double-acting piston 28, 32 is forced upward against the action of bias spring 32, and the force of input water through line 74 into area 76 forces the valve stem 60 upward. The valve seal at seat 78 is then broken, allowing high-pressure water to flow through the output expansion section 96 into jewel nozzle 102, eventually exiting as a finely-shaped, high-pressure cutting beam of water through exit port 104.

When the cutting operation is to cease, the spool drive is actuated in the reverse procedure to force hydraulic fluid from line 24 into conduit 18, and thereby drive the double-acting piston 28, 30 downward with the aid of spring bias 44. Surface 66 engages the top portion of the valve stem 60 to force the stem downward and engage seat 78 by means of tip member 90. High-pressure water is, therefore, cut off from the expansion section 96, and any excess pressure is dissipated through weep lines 84 and 88.

Such a system allows high-pressure water in the range of 60,000 psi to be used, yet achieve very rapid cycling time in the range of 25 milliseconds. Additionally, by choice of materials, a particular valve may attain a duty life cycle commensurate with that of other parts in a fluid jet cutting system.

It is apparent that modification to this basic design can be made without departing from the central concepts disclosed therein.

I claim:

1. A valve assembly comprising:

hydraulic switch means, piston means moveable in response to said hydraulic switch means, means to bias said piston means in one direction;

input means for receiving a source of high-pressure liquid, a cavity disposed in a liquid transfer relationship with said input means, a valve stem of a first material disposed in said cavity and extending to said piston means, said stem having a tip of a second material to effect a long life seal;

seal means disposed between said piston means and said cavity, said seal means having an annular seal around said valve stem of a solid material that will deform under the influence of high-pressure liquid; and output means coupled to said cavity, said output means having a valve seat for engaging said valve stem when said piston is pushed in said one direction, an expansion section for obtaining a laminar flow of high-pressure liquid, and a nozzle for shaping said flow of liquid upon release.

2. The valve assembly of claim 1 wherein said hydraulic switch means comprises a first cavity on one side of said piston means for driving said piston in said one direction, a second cavity on an opposite side of said piston means for driving said piston in a second direction, and means to reversibly drive fluid to either said first or second cavities.

3. The assembly of claim 2 wherein said means to bias said piston comprises a spring disposed in said first cavity.

4. The valve assembly of claim 3 wherein said piston means has two sections adjustable with respect to each other, the first of said two sections having a flange abutting said spring, whereby adjustment of the bias force of said spring can be adjusted, and the second of said two sections having a recess for engagement with said valve stem.

5. The valve assembly of claim 4 wherein said recess has a length in excess of said length of movement of said valve in said one direction.

6. The valve assembly of claim 3 wherein said spring biases said piston in a direction to close engage said stem with said valve seat.

7. The valve assembly of claim 1 wherein said solid material is free machining bronze, said seal means further comprising a flexible backing ring on one side of said solid material and a solid substantially undeformable packing load on the other side of said solid material.

8. The valve assembly of claim 1 further including pressure relief means operably coupled to said input means.

9. The valve assembly of claim 1 further including a nozzle holder disposed downstream of said expansion section and wherein said nozzle comprises a sapphire jewel element.

10. The valve assembly of claim 1 wherein said material of a first type is harder than said material of second type, and said valve seat for engaging said stem is fashioned from a harder material than said second type.

* * * * *